United States Patent [19]

Shibata et al.

[11] Patent Number: 4,590,497

[45] Date of Patent: May 20, 1986

[54] HEAT INSULATED THERMOSENSITIVE PAPER

[75] Inventors: Tomoo Shibata, Irvine; Wissam J. Jurdi, Tustin; Minoru Nomura, Irvine, all of Calif.

[73] Assignee: Ricoh Electronics, Inc., Irvine, Calif.

[21] Appl. No.: 668,083

[22] Filed: Nov. 5, 1984

[51] Int. Cl.[4] ..... B41M 5/18

[52] U.S. Cl. ..... 346/201; 346/200; 346/226; 427/150; 427/151; 427/152; 427/261; 428/40; 428/200; 428/344; 428/347; 428/354; 428/913

[58] Field of Search ..... 346/200, 201, 226; 427/150–152, 261; 428/209, 211, 488.1, 488.4, 913, 914, 40, 195, 200, 207, 212–214, 335, 336, 344, 347–349, 353, 354

[56] References Cited

U.S. PATENT DOCUMENTS 4,370,370 1/1983 Iwata et al. ..... 346/226
4,388,362 6/1983 Iwata et al. ..... 346/226
4,424,245 1/1984 Maruta et al. ..... 428/913
4,444,819 4/1984 Maruta et al. ..... 346/209

*Primary Examiner*—Bruce H. Hess
*Attorney, Agent, or Firm*—Walter A. Hackler

[57] ABSTRACT

A thermosensitive recording label includes a thermosensitive color-forming layer disposed on one side of a substrate and a heat reflecting layer disposed on another side of the substrate and a delayed action adhesive disposed on the heat reflecting layer. The thermosensitive recording label may be manufactured and used without a backing sheet, thus considerably reducing the weight and volume of the label. In use, the thermosensitive recording label is drawn from a roll or stack and the delayed action adhesive activated by a heat lamp, or the like, to place it in a tacky condition for placement on goods. The heat reflecting layer disposed between the delayed action adhesive and the thermosensitive color-forming layer prevents activation of the color-forming layer during heating of the delayed action adhesive.

29 Claims, 2 Drawing Figures

HEAT INSULATED THERMOSENSITIVE PAPER

The present invention relates generally to thermosensitive paper and, more particularly, to thermosensitive recording labels suitable for identifying and/or marking goods.

Labels for identification and for price marking of goods have been in use for many, many years.

In the past, conventional printing, utilizing oily or water-based inks, was used to imprint paper with the name and price of a product and thereafter glued to goods for identification.

However, there are many problems associated with conventional printing facilities which employ oily or water-based inks. For example, most oily or water-based inks will smear if insufficient drying time is not provided after printing and before the label is used on goods. In addition, it is well known that for high production, printing equipment utilizing wet inks or ink impregnated ribbon may be a very messy operation and not suitable in a grocery store or the like when on-site printing is preferred.

To overcome many of the problems associated with conventional printing, thermosensitive recording labels have been developed, such as those described in U.S. Pat. No. 4,370,379.

Utilizing a thermosensitive coloring material, which includes a colorless or light-colored leuco dye, an acidic substance capable of causing the leuco dye to undergo color formation upon heating, thermosensitive recording labels enable the recording of goods identification and pricing on a label without the presence of messy wet inks and the like.

Use of these later thermosensitive recording labels has been accompanied by various problems. For example, it is well known that when such labels are placed on plastic-wrapped products, there appears to be a degradation or fading of the heat-formed printing on the label, which has been attributed to the migration of plasticizers used in the plastic wrap which typically cover the goods onto which the labels have been applied.

Attempts to producing non-fading thermosensitive recording labels have included the addition of protective, or barrier, layers on both sides of the thermosensitive color-forming layer in order to prevent migration of the plasticizers.

While these barriers have been effective in reducing the fading of thermosensitive recording labels, they add additional cost to the labels in terms of both increasing the number of manufacturing steps necessary to produce the label and the cost of the materials involved.

In order to apply, or stick, the labels to the goods they are to identify, such labels have typically used a pressure-sensitive adhesive agent, such as an acrylic adhesive, a styrene-butadine rubber latex adhesive, a vinyl acetate adhesive or a rubber adhesive. A releasable backing sheet is normally disposed on such pressure-sensitive adhesives in order to prevent agglomeration of the labels and to keep them separated for individually removing them from the backing strip in order to apply them to goods.

While this method of applying labels to goods is effective, it has a number of drawbacks.

First, the releasable backing sheet constitutes a large volume compared to the usable product, namely, the label itself. As an example, such labels are typically placed on rolls of the backing paper, all of which must be handled during shipping and use, and furthermore, must be handled and disposed of after the thermosensitive labels are removed therefrom.

It is apparent, therefore, that this is an inefficient use of paper stock and further contributes to the overall cost of label manufacture, as well as contributing significantly to shipping and storage costs and later disposal of the backing sheet.

Early forms of labels, still in use today, utilize non-pressure-sensitive adhesives which must be wetted in order to place them into a tacky state for adhering of the label onto goods. This process, however, is also messy in that contact must be made between the adhesive surface and a moistener in order to activate the adhesive. Inevitably, adhesive builds up on the moistener and causes the use of such adhesives to be a messy operation.

It is preferable to have a thermosensitive label that does not require the use of a backing sheet in order to eliminate the disadvantages associated therewith.

Delayed action adhesives are now available in which the adhesive, which may be of an emulsion or a hot melt type, may be coated on a surface and thereafter activated by heating the adhesive.

Upon activation, the delayed action adhesive remains tacky for a preselected period of time, depending upon the composition of the adhesive. As the adhesive may be heated radiantly or convectively, no contact need be made therewith, hence, eliminating the possibility of the adhesive building up on unwanted portions of the equipment utilized for activating the adhesive.

Such adhesives have theretofore not been used with thermosensitive labels for the obvious reason that heating the delayed action adhesives would degrade, or obliterate, the thermosensitive coloring material in the label, thereby rendering the label useless.

Yet another problem associated with the use of labels on particular goods involves the chemical interaction between the label and the goods and/or packaging material. This has been mentioned hereinabove in connection with the migration of plasticizers into the label and is also evident with oily goods such as cheese, salami, and the like.

These oily products, even when wrapped with a plastic film, cause labels to discolor and spot because of oils seaping through the plastic wrap or otherwise present on the surface of the plastic wrap through handling and packaging of the goods. While this discoloration may not obliterate the markings on the labels, it renders the labels unattractive for consumers, who may relate such spotting and discoloration to old or stale products.

The present invention utilizes delayed action adhesives in conjunction with a thermosensitive layer in which the delayed action adhesive may be activated and the label applied to goods without affecting the thermosensitive color-forming layer of the label.

Further, a label produced in accordance with the present invention may be utilized on oily or greasy goods, such as cheeses, without subsequent spotting or discoloration of the layer surface, which is otherwise unacceptable from a consumer point of view.

SUMMARY OF THE INVENTION

A thermosensitive recording label, in accordance with the present invention, includes a substrate, a thermosensitive color-forming layer disposed on one side of the substrate, a heat-reflecting layer disposed on another side of the substrate, and a delayed action adhesive disposed on the heat-reflecting layer.

The delayed action adhesive becomes tacky upon the application of heat thereto and the heat-reflecting layer is of sufficient heat reflectance to prevent color formation in the color-forming layer when heat is applied to the delayed action adhesive to make it tacky.

At the same time, the heat-reflecting layer may be applied with sufficient thickness in order to prevent migration of oils from packaged goods from migrating into the thermosensitive color-forming layer. Hence, the heat-reflecting layer provides a dual function of preventing heat applied to the delayed action adhesive from entering the thermosensitive color-forming layer as well as acting as a barrier to prevent migration of oils into the color-forming layer.

More particularly, the thermosensitive color-forming layer includes a colorless or light-colored leuco dye and an acidic substance capable of causing the leuco dye to undergo color formation upon heating of the thermosensitive recording label. Aluminum may be used as the heat-reflecting layer and may be applied to the substrate by a vacuum deposition to a thickness of from about 0.5 microns to 30 microns. Alternatively, aluminum foil may be laminated to the substrate.

The delayed action adhesive may be directly coated on the heat reflective layer to a thickness from about 12 microns to about 35 microns and be of a composition enabling it to remain tacky up to about 74 hours after being activated by heating it to a temperature of about 100° F. and 300° F.

Also, in accordance with the present invention, a method for identifying and/or marking goods comprises the steps of: applying a thermosensitive color-forming layer on one side of the substrate, applying a heat-reflecting layer on the other side of the substrate, applying a delayed action adhesive on the heat-reflecting layer to form a thermosensitive recording label, the delayed action adhesive becoming activated to a tacky state when heated to a preselected activation temperature.

Next, selected areas of the thermosensitive color-forming layer are heated to form an image thereon for identifying and/or marking goods upon which the thermosensitive recording label is to be applied. The delayed action adhesive is then heated to the preselected activation temperature and thereafter the thermosensitive recording label is applied, or stuck, to goods by means of the delayed action adhesive.

BRIEF DESCRIPTION OF THE DRAWINGS

A better understanding of the present invention may be had from the consideration of the following detailed description, taken in conjunction with the accompanying drawings, in which.

DETAILED DESCRIPTION OF THE DRAWINGS

Figure 1:
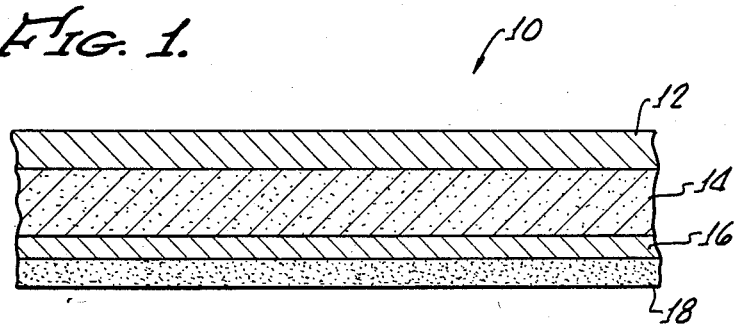
FIG. 1 is a cross-sectional view of the thermosensitive recording label, in accordance with the present invention, generally showing each of the layers of the label; and, FIG. 2 is a diagrammatical view showing a folded configuration of a plurality of labels along with representation of apparatus for producing an image on the label and for activating the delayed action adhesive before the label is applied to goods.

Turning now to FIG. 1, a thermosensitive recording label 10, in accordance with the present invention, includes a thermosensitive color-forming layer 12 disposed on a substrate 14, a heat-reflecting layer 16 and a delayed action adhesive 18 applied thereon.

In general, the substrate 14 may be of a high quality paper and the thermosensitive color-forming layer 12 may be of any suitable type well known in the art, and as described in U.S. Pat. Nos. 4,370,370 and 4,388,382.

Examples of the colorless or light-colored leuco dye and the acidic substances utilized in the color-forming layer 12 are provided in the hereinabove-referenced U.S. patents.

As is well known, a number of enhancers may be included in the thermosensitive color-forming layer in order to enhance the distinctiveness of the color images. Enhancers, such as fine powders of calcium carbonate, magnesium carbonate, alumina, silica, talc, barium sulfate, aluminum stearate, styrene resin, urea-formalin resin, or the like, may be used along with binder agents, which are also well known in the art.

Although not shown in the Figures, a water-soluble resin solution may be coated on the thermosensitive color-forming layer 12 and thereafter dried to form a protective layer. A number of well known water-soluble resins may be utilized and applied with sufficient thickness to prevent subsequent deterioration of the thermosensitive color-forming layer by plasticizers contained in plastic sheets, which may be placed on, or in contact with the thermosensitive recording label 10.

The heat-reflecting layer 16 may be applied to the substrate through the use of vacuum deposition or by laminating aluminum foil to the substrate 14. While the thickness of the aluminum heat-reflecting layer may vary depending upon the thickness of the substrate and the sensitivity of the color-forming layer 12, it is anticipated that between about 0.5 and 30 microns of aluminum provide a sufficient reflecting surface to enable activation of the delayed action adhesive 18, without damage or color-formation in the color-forming layer 12.

It is anticipated that other materials may be utilized for the heat-reflecting layer 16, as long as sufficient heat is reflected from the surface thereof, as the delayed action adhesive is heated, in order to prevent significant heating of the color-forming layer 12 which would result in unwanted coloration thereof. Aluminum, however, with its metallic, heat-conducting properties, also serves the function of assisting the uniform heating of the adhesive by conducting heat along the back side thereof.

The delayed action adhesive 18 may be of any suitable emulsion or a hot-melt type, available from National Starch & Chemicals, H. B. Fuller, Findley, etc., and sold under the product identification number of 22W9B and 22W9T, for example.

These delayed action adhesives may have activation temperatures between about 100° F. and 300° F., with the activation temperature being preselected from the delayed action adhesives currently available.

The delayed action adhesive is coated to the heat-reflecting layer in a conventional manner and thereafter dried, or cooled, to a non-activated state in which the adhesive displays no tackiness.

Figure 2:
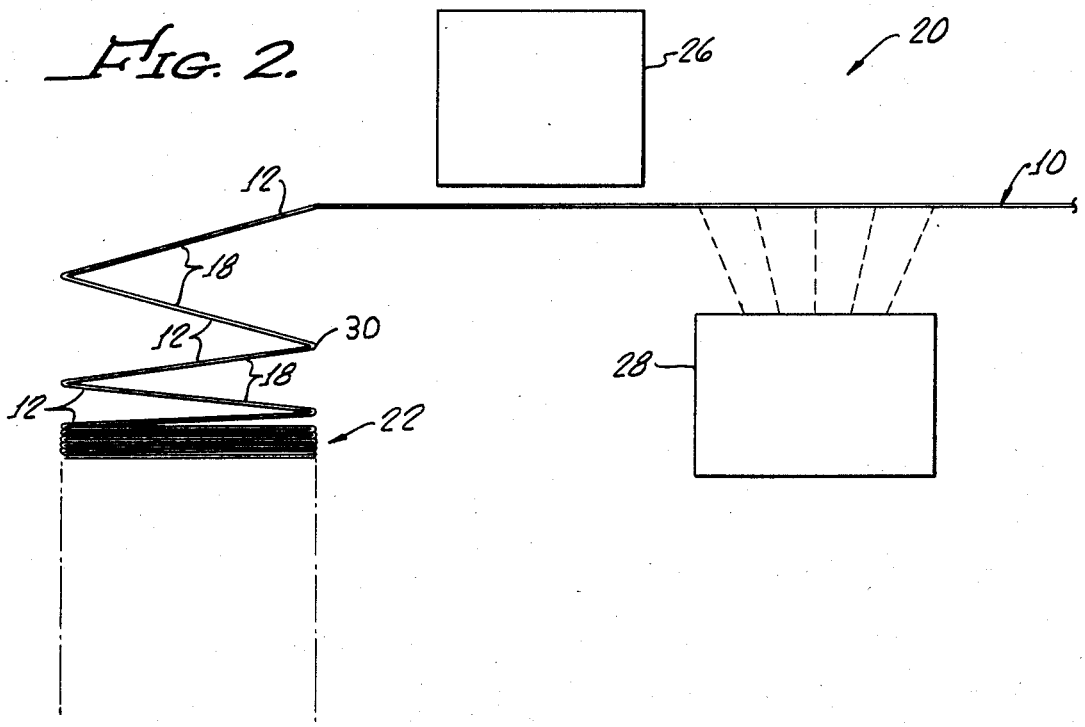

Since the delayed action adhesive is not tacky in its unactivated state, no releasable backing sheet is necessary and, further, as shown in FIG. 2, the labels may be stacked in an accordion-type manner, which provides a very compact package 22, having no wasted space as is necessary when a backing sheet must be provided on the labels.

Alternatively, the labels may be provided in rolls (not shown) and because no backing paper is required, such rolls are substantially smaller than rolls of conventional labels requiring a backing paper.

As shown in FIG. 2, the labels may be accordion folded so that the delayed action adhesive layers of adjacent labels may come in contact with each other and the color-forming layers may contact each other. In this manner, there is no contact between the delayed action adhesive layer and the color-forming layer and, hence, there is no possible interaction between the two.

In the method for identifying and/or marking goods in accordance with the present invention, following the steps of applying the thermosensitive color-forming layer to the substrate, applying the heat-reflecting layer on another side of the substrate and applying a delayed active adhesive on the heat-reflecting layer, the color-forming layer is heated in selected areas by a thermo-printing head 26, or the like, after it is pulled from the stack, or package 22, (or roll, not shown) of labels 10 to form an image thereon. Thereafter, the delayed action adhesive layer 18 may be heated by a radiant heater 28 to the preselected activation temperature to cause the delayed action adhesive to become tacky, after which the label may be removed from its position adjacent and identical label by means of perforations (not shown) formed in the accordion bends 30 of the label stack 22.

The following examples are presented by way of illustration only, and are not to be considered limited to the present invention.

EXAMPLE 1

A solution of leuco dye and acid substance was prepared as follows:

| | Parts by Weight |
|---|---|
| Dispersant A | |
| 3-diethyl-6-methyl-7-anilino fluoran | 1.5 |
| Polyvinyl alcohol (20% aqueous solution) | 5.0 |
| Water | 43.5 |
| Dispersant B | |
| Bisphenol A | 6.0 |
| Stearic acid amide | 1.0 |
| Polvinyl alcohol (20% aqueous solution) | 10.0 |
| Water | 33.0 |

The prepared Dispersant A and Dispersant B were mixed to form a thermosensitive coloring liquid which was applied to a substrate consisting of high quality paper and weighing about 58 gr./m$^2$, and thereafter dried at room temperature up to 120° C. to form a thermosensitive color-forming layer in which the solids therein amounted to about 4.0 to about 10 gr./m$^2$. Thereafter, a water-soluble resin solution comprising 5 parts of polyvinyl alcohol in 95 parts of water was applied to the heat sensitive color-forming layer and dried at about 25° to 120° C. to thereby form a protective layer over the thermosensitive color-forming layer, said protective layer having a quantity of solids of about 2 gr./m$^2$.

Aluminum was then vacuum deposited on the other side of the substrate to a thickness of 15$\mu$ and 16 lb/ream delayed action adhesive was thereafter applied to the aluminum heat-reflecting layer to a thickness of 35$\mu$.

Subsequently, a label prepared in accordance with this example was applied to cheese wrapped with polyethylene or polyolefin stretch plastic film. The label adhered to and was not easily removed from the plastic film and after 74 hours no discoloration of the color-forming layer of the label was observed.

By comparison, a label made in accordance with U.S. Pat. No. 4,370,370 was applied to the same cheese package and it was observed that after a lapse of approximately 24 hours, a discoloration of the color-forming layer was observed. It is apparent that a label made in accordance with the present invention increases the resistance to discoloration by a factor of about 3 compared to prior art labels.

Although there has been described hereinabove a specific thermosensitive recording label, in accordance with the present invention for the purpose of illustrating the manner in which the invention may be used to advantage, it will be appreciated that the invention is not limited thereto. Accordingly, any and all modifications, variations, or equivalent arrangements which may occur to those skilled in the art should be considered to be within the scope of the invention as defined in the appended claims.

What is claimed is:

1. A thermosensitive recording label comprising:
   - a substrate;
   - a thermosensitive color-forming layer disposed on one side of said substrate; said thermosensitive color-forming layer undergoing color formation upon subsequent heating thereof;
   - a heat reflecting layer disposed on another side of said substrate; and
   - a delayed action adhesive disposed on said heat reflecting layer, said delayed action adhesive becoming tacky upon the application of heat thereto;
   - said heat reflecting layer being of sufficient heat reflectance to prevent color formation in the color-forming layer when heat is applied to cause the delayed action adhesive to become tacky.

2. The thermosensitive recording label according to claim 1 wherein the heat reflecting layer comprises aluminum.

3. The thermosensitive recording label according to claim 2 wherein the heat reflecting layer has a thickness from about 0.5$\mu$ to about 30$\mu$.

4. The thermosensitive recording label according to claim 3 wherein the delayed action adhesive has a thickness from about 12 $\mu$m to about 35 $\mu$m.

5. The thermosensitive recording label according to claim 4 wherein said delayed action adhesive remains tacky for up to about 74 hours after being activated by heating.

6. The thermosensitive recording label according to claim 2 wherein the thickness of the heating reflecting layer is sufficient to prevent migration of oil from packaged products, onto which the thermosensitive recording label is affixed by the delayed action adhesive, into the thermosensitive color-forming layer.

7. The thermosensitive recording label according to claim 1 wherein the heat reflecting layer is of sufficient thickness to prevent migration of oil from packaged cheese, onto which the thermosensitive recording label is affixed by the delayed action adhesive, into the thermosensitive color-forming layer.

8. A thermosensitive recording label comprising:

a substrate;

a thermosensitive color-forming layer disposed on one side of said substrate, said thermosensitive color-forming layer comprising a colorless or light-colored leuco dye and an acidic substance capable of causing said leuco dye to undergo color formation upon heating of the thermosensitive recording label;

a heat reflecting layer disposed on another side of said substrate; and a delayed action adhesive disposed on said heat reflecting layer, said delayed action adhesive becoming tacky upon the application of heat thereto;

said heat reflecting layer being of sufficient heat reflectance to prevent color formation in the color-forming layer when heat is applied to cause the delayed action adhesive to become tacky.

9. The thermosensitive recording label according to claim 8 wherein the heat reflecting layer comprises aluminum.

10. The thermosensitive recording label according to claim 9 wherein the heat reflecting layer has a thickness from about 0.5μ to about 30μ.

11. The thermosensitive recording label according to claim 10 wherein the delayed action adhesive has a thickness from about 12 μm to about 35 μm.

12. The thermosensitive recording label according to claim 11 wherein said delayed action adhesive remains tacky for up to about 74 hours after being activated by heating.

13. The thermosensitive recording label according to claim 8 wherein the thickness of the heat reflecting layer is sufficient to prevent migration of oil from packaged products, onto which the thermosensitive recording label is affixed by the delayed action adhesive, into the thermosensitive color-forming layer.

14. The thermosensitive recording label according to claim 8 wherein the heat reflecting layer is of sufficient thickness to prevent migration of oil from packaged cheese, onto which the thermosensitive recording label is affixed by the delayed action adhesive, into the thermosensitive color-forming layer.

15. A thermosensitive recording label comprising:

a substrate;

a thermosensitive color-forming layer disposed on one side of said substrate, said thermosensitive color-forming layer comprising a colorless or light-colored leuco dye and an acidic substance capable of causing said leuco dye to undergo color formation upon heating of the thermosensitive recording label;

a heat reflecting layer disposed on another side of said substrate; and a delayed action adhesive disposed on said heat reflecting layer, said delayed action adhesive becoming activated to a tacky state when heated to an activation temperature of between about 100° F. and about 300° F.;

said heat reflecting layer being of sufficient heat reflectance to prevent color formation in the color-forming layer when heat is applied to cause the delayed action adhesive to become tacky.

16. The thermosensitive recording label according to claim 15 wherein the heat reflecting layer comprises aluminum.

17. The thermosensitive recording label according to claim 16 wherein the heat reflecting layer has a thickness from about 0.5μ to about 30μ.

18. The thermosensitive recording label according to claim 17 wherein the delayed action adhesive has a thickness from about 12 μm to about 35 μm.

19. The thermosensitive recording label according to claim 18 wherein said delayed action adhesive remains tacky for up to about 74 hours after being activated by heating.

20. The thermosensitive recording label according to claim 16 wherein the thickness of the heat reflecting layer is sufficient to prevent migration of oil from packaged products, onto which the thermosensitive recording label is affixed by the delayed action adhesive, into the thermosensitive color-forming layer.

21. The thermosensitive recording label according to claim 16 wherein the heat reflecting layer is of sufficient thickness to prevent migration of oil from packaged cheese, onto which the thermosensitive recording label is affixed by the delayed action adhesive, into the thermosensitive color-forming layer.

22. A method for identifying and/or marking goods comprising the steps of:

applying a thermosensitive color-forming layer on one side of a substrate;

applying a heat-reflecting layer on another side of the substrate;

applying a delayed action adhesive on said heat reflecting layer to form a thermosensitive recording label, said delayed action adhesive becoming activated to a tacky state when heated to a preselected activated temperature;

heating selected areas of said thermosensitive color-forming layer to form an image thereon for identifying and/or marking goods upon which the thermosensitive recording label is to be applied;

heating the delayed action adhesive to the preselected activated temperature; and, sticking the thermosensitive recording label to the goods by means of the activated delayed action adhesive.

23. The method according to claim 22 wherein the heat reflecting layer comprises aluminum foil and is applied to the substrate by laminations.

24. The method according to claim 22 wherein the heat reflecting layer comprises aluminum and is applied to the substrate by vacuum deposition.

25. The method according to claim 24 wherein the heat reflecting layer is applied with a thickness from about 0.5μ to about 30μ.

26. The method according to claim 25 wherein the delayed action adhesive is applied with a thickness from about 12μ to about 35μ.

27. The method according to claim 26 wherein said delayed action adhesive remains tacky for up to about 74 hours after being activated by heating.

28. The method according to claim 22 wherein the heat reflecting layer is applied with sufficient thickness to prevent migration of oil from packaged products, onto which the thermosensitive recording label is affixed by the delayed action adhesive, into the thermosensitive color-forming layer.

29. The method according to claim 22 wherein the heat reflecting layer is applied with sufficient thickness to prevent migration of oil from packaged cheese, onto which the thermosensitive recording label is affixed by the delayed action adhesive, into the thermosensitive color-forming layer.

* * * * *